US007431085B2

(12) United States Patent
Coronado et al.

(10) Patent No.: US 7,431,085 B2
(45) Date of Patent: Oct. 7, 2008

(54) GRAVEL PACK MULTI-PATHWAY TUBE WITH CONTROL LINE RETENTION AND METHOD FOR RETAINING CONTROL LINE

(75) Inventors: Martin Coronado, Cypress, TX (US); Steve Crow, Kingwood, TX (US); Elmer Peterson, Porter, TX (US); Luis Mendez, Houston, TX (US); James Zachman, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 29 days.

(21) Appl. No.: 11/330,757

(22) Filed: Jan. 12, 2006

(65) Prior Publication Data

US 2006/0219404 A1 Oct. 5, 2006

Related U.S. Application Data

(60) Provisional application No. 60/643,819, filed on Jan. 14, 2005.

(51) Int. Cl.
*E21B 43/04* (2006.01)

(52) U.S. Cl. ..... 166/278; 166/241.6; 166/51

(58) Field of Classification Search ..... 166/241.6, 166/278, 243.3, 384, 51
See application file for complete search history.

(56) References Cited

U.S. PATENT DOCUMENTS

| | | | | |
|---|---|---|---|---|
| 5,343,942 | A | 9/1994 | Del Serra et al. | 166/66.4 |
| 6,595,284 | B2 * | 7/2003 | Davis | 166/241.4 |
| 7,044,232 | B2 * | 5/2006 | Jordon et al. | 166/380 |
| 2002/0092649 | A1 | 7/2002 | Bixenman et al. | 166/278 |
| 2002/0174984 | A1 * | 11/2002 | Jones | 166/278 |
| 2005/0161227 | A1 * | 7/2005 | Hayes et al. | 166/380 |
| 2007/0131421 | A1 * | 6/2007 | Hurst et al. | 166/278 |

FOREIGN PATENT DOCUMENTS

| | | | |
|---|---|---|---|
| GB | 2392461 | A | 3/2004 |
| WO | WO 02/081862 | A1 * | 10/2002 |
| WO | WO 2004/044376 | A1 | 5/2004 |

OTHER PUBLICATIONS

PCT International Search Report, International Application No. PCT/US2006/001144.

* cited by examiner

*Primary Examiner*—David Bagnell
*Assistant Examiner*—Robert E Fuller
(74) *Attorney, Agent, or Firm*—Cantor Colburn LLP

(57) ABSTRACT

A gravel pack multi-pathway tube includes a body and a flow passage at the body. Further, the tube includes a projection at the body, the projection receptive to a control line. A gravel packing device component wherein the component includes a shroud, a multi-pathway tube at the shroud, and a projection appurtenant the multi-pathway tube, the projection being receptive to a control line. A method for running and protecting a control line at a gravel pack component, which includes running a component into a wellbore wherein the component includes a shroud, a multi-pathway tube at the shroud, and a projection appurtenant the multi-pathway tube, the projection being receptive to a control line and inserting a control line at the projection.

12 Claims, 5 Drawing Sheets

GRAVEL PACK MULTI-PATHWAY TUBE WITH CONTROL LINE RETENTION AND METHOD FOR RETAINING CONTROL LINE

CROSS REFERENCE TO RELATED APPLICATIONS

This application claims the benefit of an earlier filing date from U.S. Provisional Application Ser. No. 60/643,819 filed Jan. 14, 2005, the entire disclosure of which is incorporated herein by reference.

BACKGROUND

In oil and gas wells, multi-pathway tubes around screen shrouds are known to convey gravel pack slurry beyond annular obstructions of any kind. In general, such multi-pathway tubes (also termed alternate path technology) begin "operating" automatically when an obstruction such as an annular bridge arises. Multi-pathway tubes are open to the annulus just downstream of a gravel pack packer and provide an alternate path for the flow of the slurry if indeed gravel slurry pressure rises due to an annular obstruction. Where no annular obstruction exists, the multi-pathway tube is naturally bypassed for the easier flowing a Where the multi-pathway tube does become a slurry conduit, that slurry is reintroduced to the annulus downstream of the obstruction by exiting ports in the multi-pathway tube where pressure in the annulus allows. Because of the high pressure in the multi-pathway tube, the slurry tends to exit at a high velocity. Slurry being by nature erosive, a property exacerbated by high velocity, it is a very effective cutting implement. Any type of control line utilized must be protected from this discharge.

In order to run control lines downhole, the art has clamped the lines to outside of the screen shroud, and run an additional screen shroud outside of the multi-pathway tubes. This may be effective but does increase the overall outside dimension of the assembly. As one of skill in the art is all too aware, increasing an outside dimension or reducing an inside dimension are to be avoided.

SUMMARY

Disclosed herein is a gravel pack multi-pathway tube that includes a body and a flow passage at the body. Further, the tube includes a projection at the body, the projection receptive to a control line.

Further disclosed herein is a gravel packing device component wherein the component includes a shroud, a multi-pathway tube at the shroud, and a projection appurtenant the multi-pathway tube, the projection being receptive to a control line.

Yet further disclosed herein is a method for running and protecting a control line at a gravel pack component, which includes running a component into a wellbore wherein the component includes a shroud, a multi-pathway tube at the shroud, and a projection appurtenant the multi-pathway tube, the projection being receptive to a control line and inserting a control line at the projection.

Yet further disclosed herein is a multi-pathway tube including an elongated body cross-sectionally defining a flow passage, the body having a radially larger boundary and a radially smaller boundary, the boundaries joined laterally by semicircular boundaries. A projection extends from the radially larger boundary and has a substantially equivalent radius of curvature, the projection being receptive to a control line to provide retention for the control line.

BRIEF DESCRIPTION OF THE DRAWINGS

Referring now to the drawings wherein like elements are numbered alike in the several Figures.

DETAILED DESCRIPTION

Figure 1:
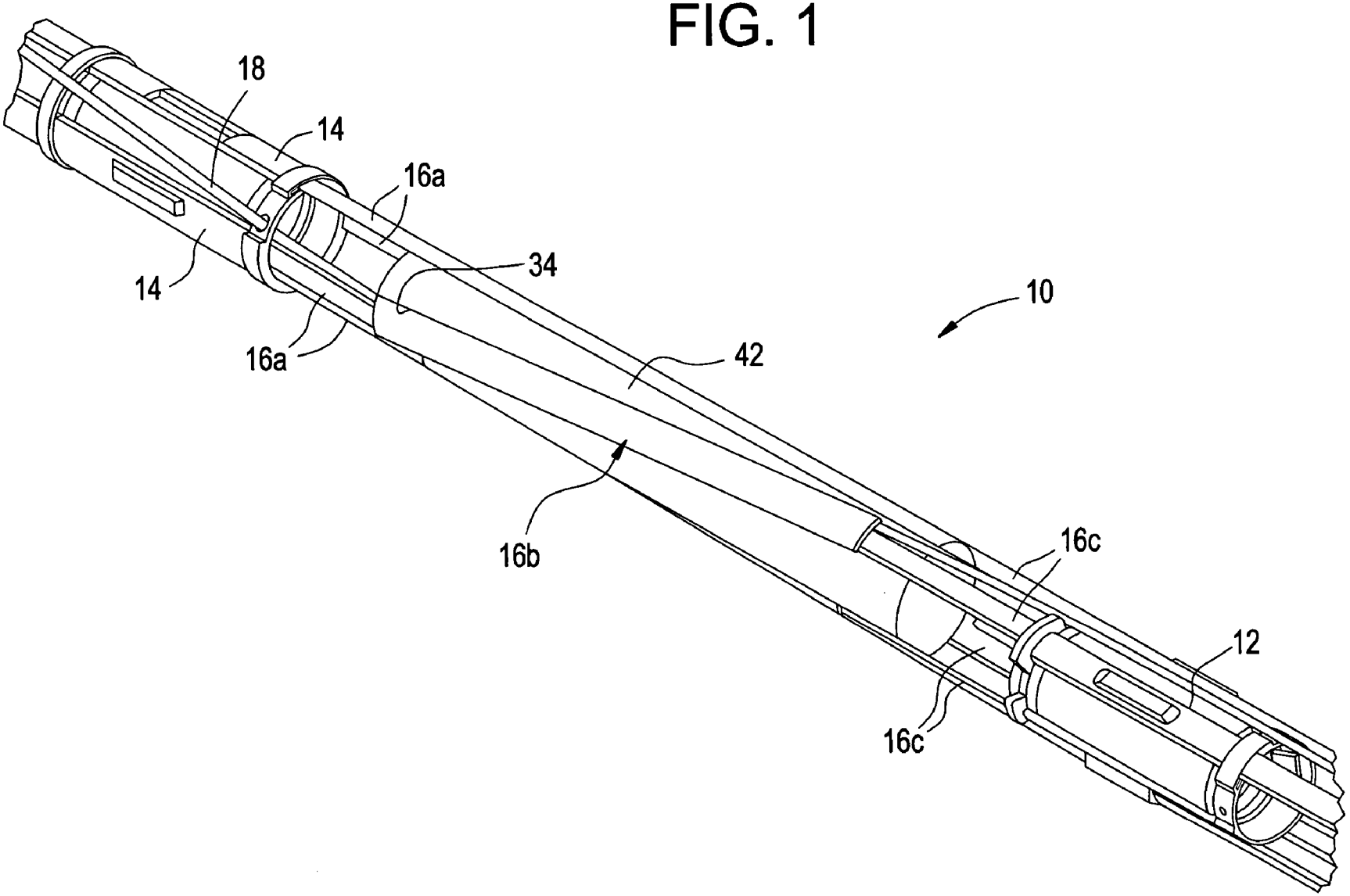
FIG. 1 is a perspective schematic view of a gravel pack component illustrating multi-pathway tubes and a control line.

Referring to FIG. 1, some of the components of a gravel packing apparatus 10 are illustrated to provide environment for the arrangement disclosed herein. In FIG. 1, a cross coupling connector 12 is illustrated twice with a space interval. The space interval is occupied primarily by a gravel pack screen. Such screens are known to the art and do not require explanation here. The screen itself is not shown in the figures hereof but will be understood by one of ordinary skill in the art to be beneath the screen shroud (identified as 42 hereunder), which is represented in the figures. Although the view includes only two connectors 12, it is to be understood that more (or only one) may be utilized in the gravel pack apparatus 10. Each connector 12 is illustrated with pass-through 14 for four multi-pathway tubes 16*a*. The tubes 16*a* proceed longitudinally and meet in a fluid conveyable manner with multi-pathway tubes 16*b*. Multi-pathway tubes 16*b* proceed helically along apparatus 10 until meeting in a fluid conveyable manner with multi-pathway tubes 16*c*. Multi-pathway tubes 16*c* proceed longitudinally into the next connector 12. It will be understood that tubes 16*a-c* are each considered a multi-pathway tube and are broken into parts merely to aid discussion. As noted, four multi-pathway tubes 16*a-c* are illustrated; it is to be understood that more or fewer can be utilized as desired.

At each connector 12, at least one of the multi-pathway tubes 16*a-c* will have ports (not shown but known to one of skill in the art and present in the commercially available "direct pak" screen from Baker Oil Tools, Houston, Tex.). Multi-pathway tubes adjacent those with ports will not have ports. A particular tube will have ports for about one-quarter of the total length of the screen component (see screen shroud 42) of the gravel pack apparatus 10. For example, a 1000-foot screen will have the ports change four times, once at each 250-foot increment of the 1000-foot screen. Each change will occur at a cross coupling connector 12. The fact that one of the tubes 16*a-c* will not have ports at each increment means that such tube may safely retain a control line 18 in an appurtenant projection (specifically identified hereunder). To maintain the control line in safety along the entirety of the screen section, the line may be moved back and forth between adjacent appurtenant projections at the end of each increment, with the change taking place at a connector 12. As is apparent from the foregoing, a desired location for the control line is along one of the tubes 16*b* that does not have ports. Utilizing this arrangement, a control line may be secured in a position that is not particularly exposed to the high velocity gravel slurry while also avoiding the need for any external clamps or extra shroud. Further, because of the ability of the control line to be shifted back and forth between adjacent tubes 16*a-c*, the control line may be kept away from the high velocity slurry over the entire extent of the screen section (see screen shroud 42) of apparatus 10.

Figure 2:
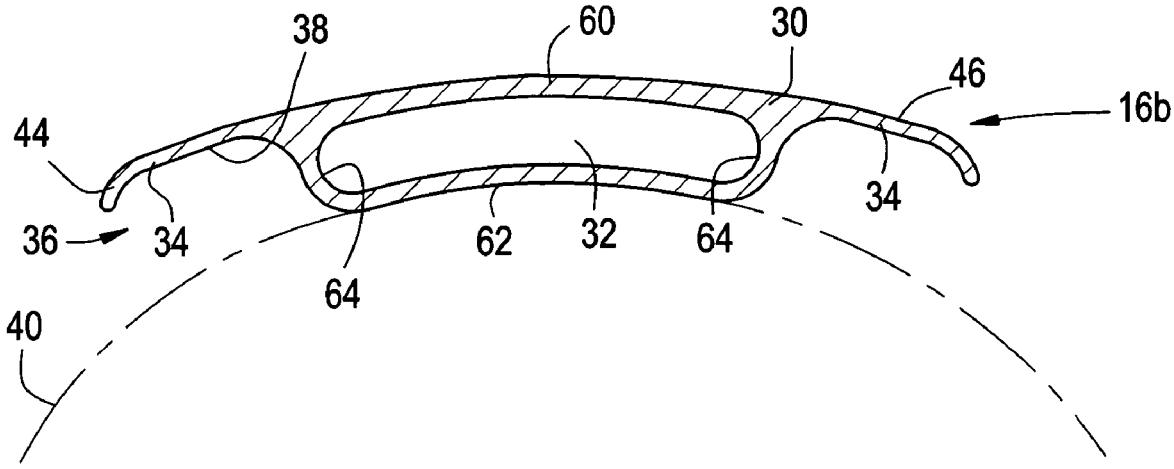
FIG. 2 is a cross-sectional view of the multi-pathway tube with a screen shroud shown in phantom.

Because of the arrangement noted, the inventors hereof determined that securement of the control line near a multi-pathway tube that did not include ports for each of the segments of the apparatus would be advantageous. Unfortunately, there was no known way to achieve this without resorting to external clamps, which suffer from the drawbacks noted above. Referring to FIG. 2, a cross-section view of a multi-pathway tube 16*b* according to the teaching herein is illustrated. Tube 16*b* includes a body 30 defining a flow passage 32, the body having a radially larger boundary 60 and a radially smaller boundary 62, the boundaries joined laterally by semicircular boundaries 64. Further, appurtenant the body 30 is at least one, and as illustrated two, wing-shaped projections 34. Each projection 34 extends from body 30, at a substantially equivalent radius of curvature to the radially larger boundary 60, at a lateral edge thereof and extends for a length sufficient to receive a control line (not shown). Each projection forms a pocket 36 between a concave surface 38 thereof and an outer surface 40 (shown in phantom) of screen shroud 42 (see FIG. 1). Advantageously, projection 34 includes a lip 44 at an end thereof remote from body 30. Lip 44 is useful for enhancing retention of control line 18 once inserted at projection 34. Further, lip 44 causes an outside surface 46 of projection 34 to present a convex configuration, which is helpful with respect to avoiding hang-ups during the running of the apparatus 10.

As noted above, tube 16*b* is helically arranged about shroud 42, which additionally assists in maintaining the control line 18 against the shroud 42.

Figure 3:
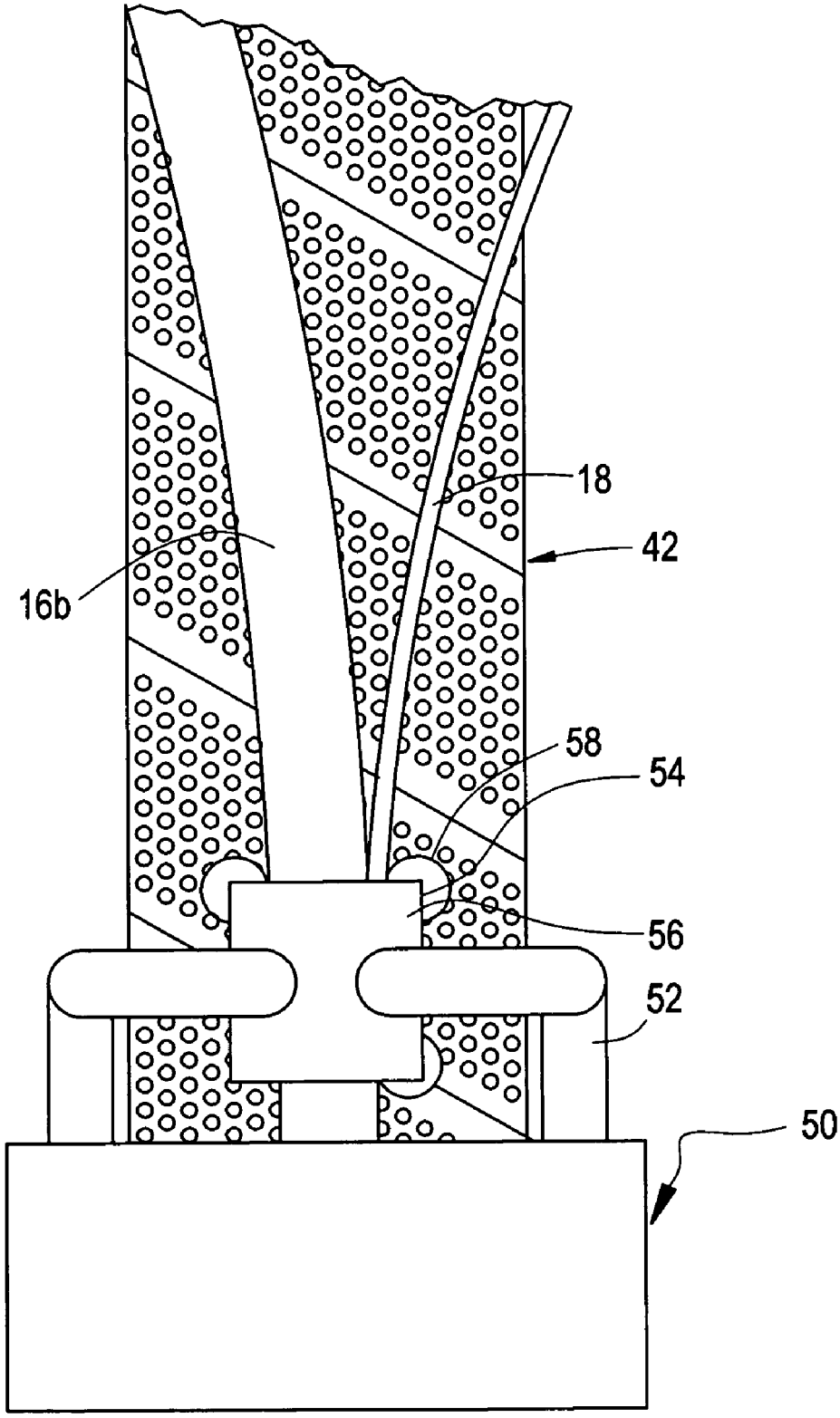
FIG. 3 is a schematic elevation view of the component illustrated in FIG. 1 entering a rotary and the control line being inserted.
Figure 4:
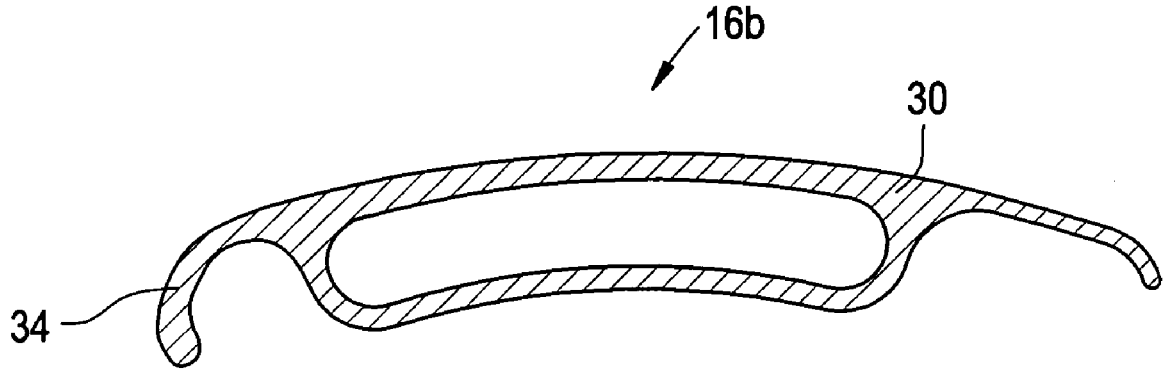
FIG. 4 is a view similar to FIG. 2 but with one of the projections bent.

Referring to FIG. 3, a schematic representation depicting shroud 42, tube 16*b*, control line 18 and an insertion device is provided. A rotary table 50 is known to the art and requires no explanation. Extending from a portion of the table 50 is a support 52 upon which is mounted a cable snap machine 54. The cable snap machine 54 is here illustrated to comprise a body 56 and four rolling or non-rolling bushings 58. It is to be understood that more or fewer bushings could be utilized and that bearings could be substituted without departing from the scope of the disclosure hereof. The bushings 58 that are horizontally (in the figure) spaced from each other are a fixed distance apart, that distance calculated to support the tube 16*b* at one side and urge the control line 18 under the projection 34 on the other side of the same tube 16*b*. Movement of the shroud (and the rest of the apparatus 10) in a downward direction (relative to the figure) automatically causes the control line to engage the projection 34. The second pair of bushings illustrated lower in the figure either further engage the control line with the projection or merely ensure that it engaged appropriately when passing through the first set of bushings. Additionally, in one embodiment, if one of the wing-shaped projections 34 at the multi-pathway tube does not contain a control line, the snap machine may be configured to deform the unsupported projection inwards toward the screen shroud 42 to reduce the possibility of the unsupported projection 34 coming in contact with any restrictions in the wellbore, which may potentially damage the flow area section of the tube. Such a condition is illustrated in FIG. 4. The deforming of the projection can be accomplished simultaneously while the control line is being snapped into the other side of the tube or can be accomplished without regard for whether or not a control line is present on the other side of the tube 16*b*.

Figure 5:
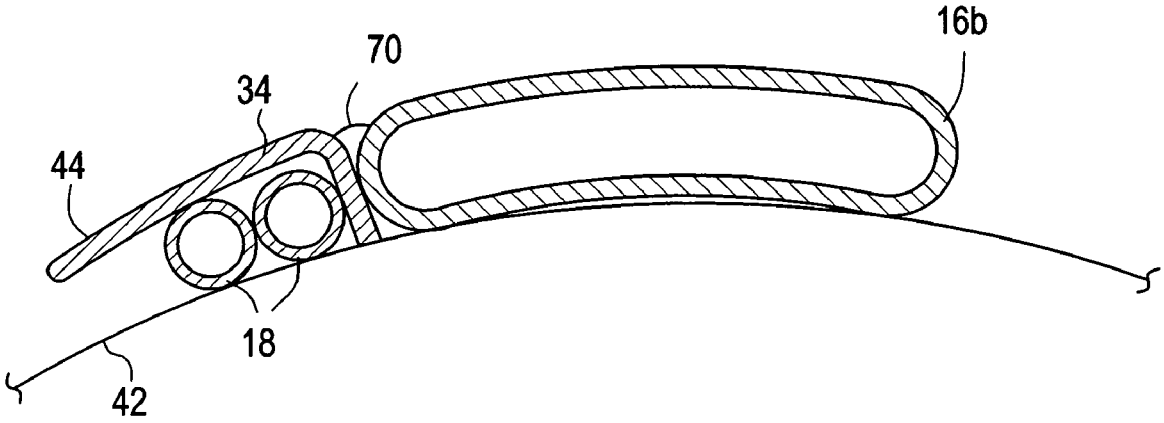
FIG. 5 is a schematic representation of an alternative multi-pathway tube.
Figure 6:
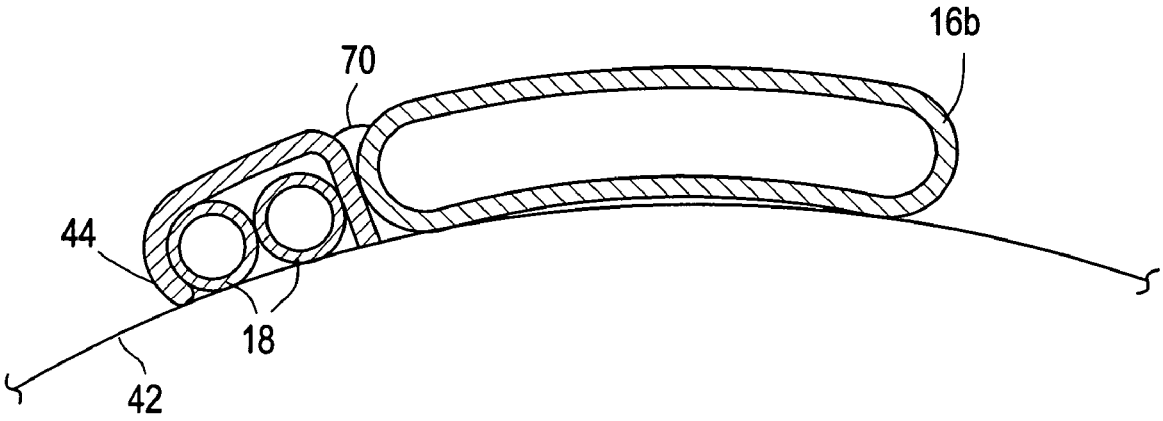
FIG. 6 is a schematic representation of the alternative multi-pathway tube of FIG. 5 in a completed condition.

In yet another embodiment, referring to FIGS. 5 and 6, the projection 34 (here illustrated to be welded at weld bead 70 onto the multi-pathway tube 16*b*) is deformed over an inserted control line by bending lip 44 toward the shroud 42 to more permanently and encapsulatively engage the control line. The lip is illustrated in the undeformed condition in FIG. 5 and in the deformed condition in FIG. 6. The snap in machine is easily modifiable to accomplish the deforming of the projection to encapsulate the control lines against the shroud 42 by substituting a differently shaped bushing or bearing having a concave shape to form the lip 44.

Earlier in this disclosure, it was stated that the control line is maintained in a protected position relative to ports in the multi-pathway tubes 16*b*. When inserting the control line into the tube 16*b*, and after a one-quarter length of the total gravel screen is reached the control line is manually moved over to position it to be engaged by an adjacent tube 16*b*. The process of inserting the control line 18 then continues as described hereinabove. One of skill in the art should appreciate that when the line 18 is moved over to an adjacent tube 16*b*, the line will be on a physically opposite side of the machine 54. In an embodiment where each side of machine 54 is a mirror image, no adjustment will be necessary but only a reengagement with the control line need be performed. Alternatively, and where one of the described embodiments that causes deformation is utilized, the machine 54 will be adjusted to reverse the action of the machine such as by reversing the bushings 58.

In accordance with the concepts and apparatus disclosed herein, control lines hereby can be added to the apparatus 10 right on the rig floor and while the apparatus is being run in the hole. Resultantly, the control line is protected and maintained in position. It is to be understood that "control line" as used herein is intended to include single or multiple hydraulic, electrical, fiber optic lines, etc. and that the lines may be individual in form, nested, flat packed, etc.

While preferred embodiments have been shown and described, modifications and substitutions may be made thereto without departing from the spirit and scope of the invention. Accordingly, it is to be understood that the present invention has been described by way of illustrations and not limitation.

What is claimed is:

1. A gravel packing device component comprising:

a shroud;

a multi-pathway tube outside the shroud; and a projection extending laterally from the multi-pathway tube to create a protected space between the projection and the shroud, the space being receptive to a control line wherein the projection holds the control line between a surface of the projection and a surface of the shroud.

2. The gravel packing device component as claimed in claim 1 wherein the multi-pathway tube and projection extend helically along a longitudinal extent of the component.

3. A method for running and protecting a control line at a gravel pack component comprising:

running a component having a shroud, a multi-pathway tube at the shroud; and a projection extending laterally from the multi-pathway tube to create a protected space between the projection and the shroud, the space being receptive to a control line into a wellbore; and inserting a control line by urging a rolling or sliding implement against a source of control line in a direction calculated to engage the projection.

4. The method for running and protecting a control line at a gravel pack component as claimed in claim 3 wherein the inserting includes:

diverting the control line to an adjacent multi-pathway tube projection to avoid control line contact with multi-pathway tube ports.

5. The method for running and protecting a control line at a gravel pack component as claimed in claim 3 wherein the component includes two or more multi-pathway tubes having ports, the ports being staggered with respect to a longitudinal extent of the component such that ports of one multi-pathway tube do not overlap ports from another multi-pathway tube and the method includes inserting the control line in the projection of one of the multi-pathway tubes alternates to maintain the control line away from the ports.

6. The method for running and protecting a control line at a gravel pack component as claimed in claim 3 wherein the method further includes deforming the projection toward the shroud.

7. The method for running and protecting a control line at a gravel pack component as claimed in claim 6 wherein deforming is around a control line.

8. The method for running and protecting a control line at a gravel pack component as claimed in claim 6 wherein deforming is without a control line.

9. The method for running and protecting a control line at a gravel pack component as claimed in claim 6 wherein deforming is on a projection opposite a projection in which a control line is inserted.

10. A multi-pathway tube comprising:

an elongated body cross-sectionally defining a gravel slurry flow passage, the body having a radially larger boundary and a radially smaller boundary, the boundaries joined laterally by semicircular boundaries together defining the gravel slurry flow passage; and a projection extending laterally from a longitudinal extent of the radially larger boundary and having a substantially equivalent radius of curvature, the projection being receptive to a control line to provide retention for the control line and protection of the control line between the projection and a separate structure.

11. The multi-pathway tube as claimed in claim 10 wherein the projection further comprises a lip at the projection remote from the body.

12. The multi-pathway tube as claimed in claim 11 wherein the lip extends from the projection toward a radius of curvature equivalent to the radially smaller boundary.

* * * * *